US007389940B2

(12) United States Patent
Kurzo

(10) Patent No.: US 7,389,940 B2
(45) Date of Patent: Jun. 24, 2008

(54) METHOD AND DEVICE FOR FIXING A GUIDE RAIL

(75) Inventor: Yvan Kurzo, Lucerne (CH)

(73) Assignee: Inventio AG, Hergiswil NW (CH)

( * ) Notice: Subject to any disclaimer, the term of this patent is extended or adjusted under 35 U.S.C. 154(b) by 742 days.

(21) Appl. No.: 10/767,644

(22) Filed: Jan. 29, 2004

(65) Prior Publication Data

US 2004/0216963 A1 Nov. 4, 2004

Related U.S. Application Data

(63) Continuation of application No. PCT/CH02/00407, filed on Jul. 22, 2002.

(30) Foreign Application Priority Data

Jul. 30, 2001 (EP) ..... 01810745.8

(51) Int. Cl.
*E01B 9/00* (2006.01)

(52) U.S. Cl. ..... 238/310; 187/408; 238/351; 238/377

(58) Field of Classification Search ..... 187/408; 238/283, 382, 284, 285, 302, 349, 351, 310, 238/315, 317, 338, 341, 343, 377
See application file for complete search history.

(56) References Cited

U.S. PATENT DOCUMENTS

| | | | | |
|---|---|---|---|---|
| 1,836,713 | A * | 12/1931 | Hewitt | 238/304 |
| 4,431,087 | A * | 2/1984 | Karol | 187/408 |
| 5,346,131 | A * | 9/1994 | Meier et al. | 238/283 |

FOREIGN PATENT DOCUMENTS

| | | |
|---|---|---|
| EP | 0 223 897 | 6/1987 |
| EP | 0 448 839 | 10/1991 |
| JP | 2001 106445 | 4/2001 |

* cited by examiner

*Primary Examiner*—Mark T. Le
(74) *Attorney, Agent, or Firm*—Fraser Clemens Martin & Miller LLC; William J. Clemens

(57) ABSTRACT

A method and a device for attaching an elevator guide rail to a substrate via a floating mount. The floating mount includes at least one of a base support, a side support, and a backside support. Each of the supports has a moveable part, a stop and a flexible element floatingly supporting the moveable part. Deforming forces cause the guide rail and the moveable part to move in a deforming direction deforming the flexible element until the deforming force exceeds a predetermined limit whereupon the stop limits further movement of the guide rail.

26 Claims, 5 Drawing Sheets

METHOD AND DEVICE FOR FIXING A GUIDE RAIL

This application is a continuation of PCT/CH02/00407 filed on Jul. 22, 2002.

BACKGROUND OF THE INVENTION

The invention relates to a method and a device for attaching an elevator guide rail in an elevator shaft.

Guide rails are used for guiding objects, i.e. for guiding elevator cars. Generally, several guide rails are connected to form a longitudinal rail section, with the guide rails being individually installed on the base using fixing devices. The elevator cars are moved hanging from cables and are guided along the rail section using guide wheels. The straightness of the guide rails is important for ensuring a comfortable ride. Where the guide rails are not absolutely straight this will lead to vibrations in the elevator car. These vibrations are particularly noticeable in case of long rail sections and fast elevator cars, as used, for instance, in high buildings, where these vibrations are perceived as disadvantageous by passengers.

The straightness of the rail section is influenced by a variety of interfering forces, such as the contraction of the building in which the rail section is installed, compression or deformation of the rail section by the operating load, deformation of the rail section by wind load, thermal expansion of the rail section or of the fixing devices, etc.

In order to eliminate these adverse effects, efforts are made to install the guide rails in such a way that only movement in the longitudinal direction of the rail section is possible between the guide rails and the fixing devices, whilst any movement in transverse direction to the rail section is prevented.

European patent document EP 0 448 839 shows in this respect a device for attaching a guide rail, in which the guide rail with a rail base is positioned laterally against brackets, with the brackets protruding partially over the rail base and pressing the guide rail onto the substrate with the back of the rail base. The brackets also contain spring assemblies, radially pressing the pretensioned guide rail, i.e. on one plane perpendicular to the longitudinal direction of the guide rail, onto the substrate. The pretensioning force is set with interchangeable spacer blocks in the brackets and an interchangeable support lining between the back of the rail base and the substrate.

As another prior art example, European patent document EP 0 763 494 shows a procedure and a device for attaching a guide rail, in which the rail base is laterally held by holding elements, whilst clamping elements, partially projecting over the rail base, radially guide the guide rail with a predetermined play, i.e. on a plane perpendicular to the longitudinal direction of the guide rail in relation to the substrate, to prevent the guide rail from lifting off the substrate. The play between the clamping elements and the top of the rail base is adjusted with adjusting nuts. The adjusting nuts are screwed onto threaded bolts of the holding elements and are adjustable on the thread sections of the threaded bolts. The thus set and predetermined play is secured with a securing means.

SUMMARY OF THE INVENTION

One of the first tasks of the method and device according to the present invention is thus to provide a procedure and a device for attaching a guide rail that provides an improved ride due to the rail section being straighter. A further task of the present invention is to provide a procedure and a device for attaching a guide rail, allowing a simple, secure, rapid and precise installation of the guide rail. Another task of the present invention is to provide a procedure and a device for attaching a guide rail that is compatible with proven mechanical engineering techniques and standards.

The present invention is based on the idea of providing a floating mount for the guide rail. A floating mount is a mount compensating a radial offset as well as an angular offset between the guide rail and the fixing device. A radial offset is an offset on a plane perpendicular to the longitudinal direction of the guide rail. An angular offset is an offset on a plane with an angle other than zero from the longitudinal direction of the guide rail. The radial offset as well as the angular offset are a consequence of temporary, or permanent, interfering forces and installation inaccuracies.

Contrary to the prior art devices, in which the guide rail is spring mounted or attached with a certain play and where only a radial offset is compensated for via radially arranged spring assemblies or by a radial play between clamping elements and the guide rail, the present invention thus provides attachment of the guide rail on the substrate via a floating mount, with the floating mount absorbing radial as well as angular interfering forces. The floating mount provides a more comfortable ride, as such a soft mounting of the guide rail cushions any unevenness of the guide rail when the elevator car passes. The springy rigidity of the guide rail in the fixing plane is reduced so that any momentum exerted by the passing elevator car is only noticed to a limited extent as vibrations in the elevator car.

In an advantageous embodiment of a device for attaching a guide rail according to the present invention, the floating mount contains at least one side support with at least one flexible sleeve element or at least one base support with at least one flexible strip unit or at least a backside support with at least one flexible disc element. The floating mount thus absorbs selected or successive interfering forces at various points. The flexible sleeve element is laterally mounted on a side of the rail base of the guide rail, compensating for any interfering forces acting at this contact point. The flexible strip unit is mounted between the guide rail and the substrate, compensating for any interfering forces acting at this contact point. The flexible disc element is mounted on the back of a rail base of the guide rail, compensating for any interfering forces acting at this contact point. Preferably, the flexible sleeve element or the flexible disc element and the flexible strip unit are mounted on the guide rail whilst pretensioned, permitting a simple, quick, secure and accurate adjustment of the mounting of the guide rail without the overall pretensioning force, applied to the rail base, exceeding a predetermined limit.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
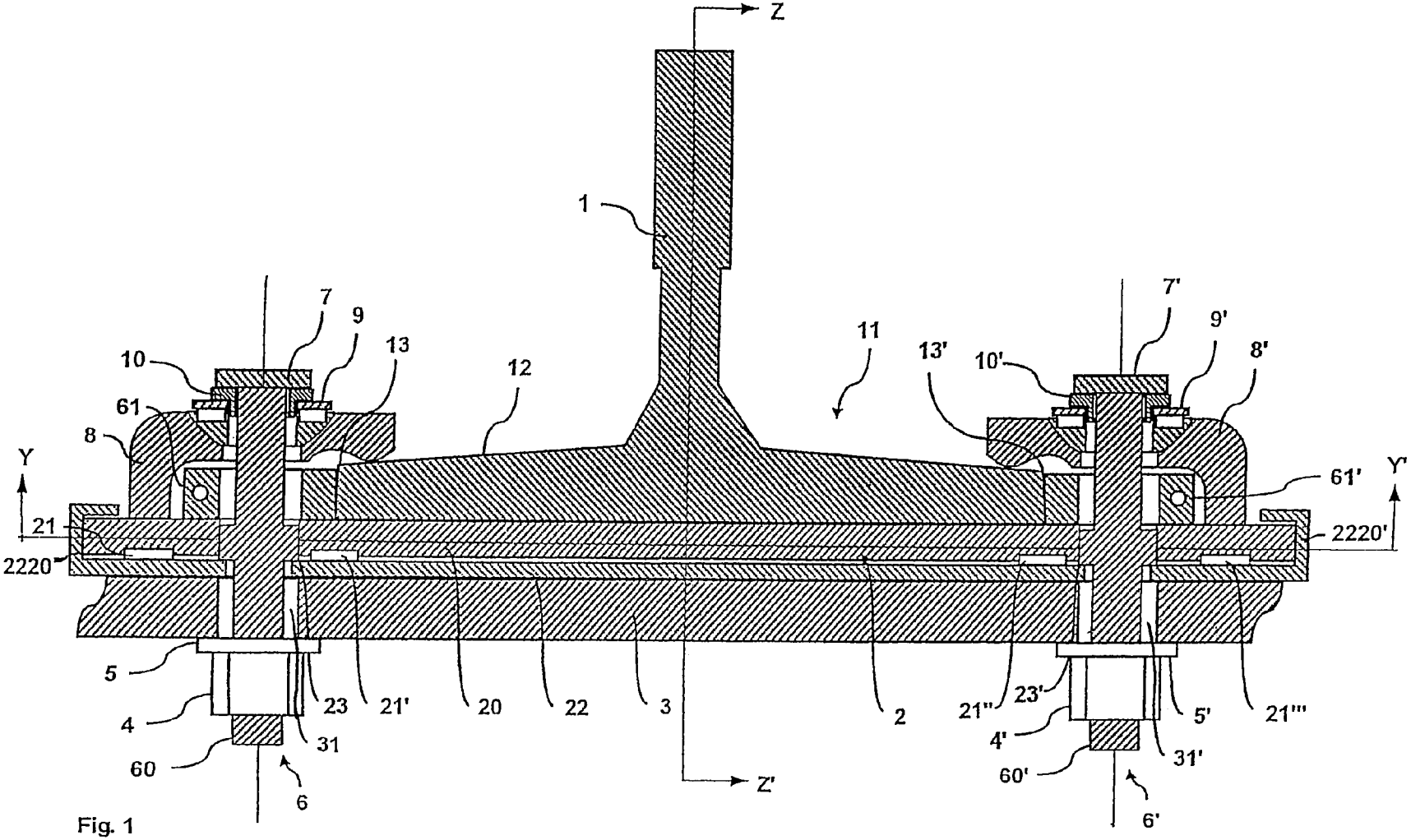
FIG. 1 is a sectional view transverse to a longitudinal axis of a guide rail showing a fixing device for attaching the guide rail in accordance with the present invention.

FIG. 1 shows part of an exemplary embodiment of a fixing device for attaching a guide rail 1 to a structure. The guide rail 1 is, for instance, a guide rail for an elevator car (not shown). Experts are familiar with such guide rails and such guide rails are, for instance, made from metal, i.e., steel, stainless steel, etc. and are shaped like a T-section. Typically, guide rails are formed in sections and arranged end-to-end along a longitudinal "X" axis perpendicular to the plane of FIG. 1. When looking along a height axis defined by a line Z-Z' extending transverse to the longitudinal axis of the guide rail 1, a bottom part of the T-section is referred to as a rail base 11, a top side of the rail base 11 is referred to as rail base back 12 and left and right sides of the rail base 11 are referred to as sides 13, 13' of the rail base. The sides 13, 13' of the rail base 11 extend along a lateral axis defined by a line Y-Y' transverse to both the height axis Z-Z' and the longitudinal axis of the guide rail 1.

The guide rail 1 is held on a substrate 3. The substrate 3 is, for instance, a rail square—not shown in detail—made from metal such as steel or stainless steel, etc. and fixed in an elevator shaft of an elevator installation in a manner familiar to experts. The guide rail 1 is mechanically fixed against lateral movement along the lateral axis Y-Y' in relation to its longitudinal extension and is mechanically fixed to prevent lifting off from the substrate 3 along the height axis Z-Z'. Mechanical fixing refers to a reversible, positive or non-positive fixing. The guide rail 1 is retained in such a way that movement in the longitudinal direction of the rail section is possible.

Although not mandatory, the fixing device according to the present invention preferably contains at least one side support 6, 6'. The side supports 6, 6' can, for instance comprise a pin body 60, 60' and at least one sleeve 61, 61'. The sleeves 61, 61' can, for instance sit tightly against the respective pin bodies 60, 60'. The pin bodies 60, 60' and the sleeves 61, 61' are, at least partially, made from metal, i.e. steel, stainless steel, etc. or from plastic. Each of the side supports 6, 6' is fixed at at least two physically separated points.

At a first point, each of the side supports 6, 6' is mechanically fixed to the substrate 3. The pin bodies 60, 60' protrude through respective holes 31, 31' of the substrate 3 and each of the sleeves 61, 61' sits against one side of the substrate 3. One underside of each of the sleeves 61, 61' can, for instance, sit indirectly against the first side of the substrate 3 via an optional base support 2. A first end of the pin bodies 60, 60' includes, for instance, a thread for securing at least one nut 4, 4' on a section. At least one washer 5, 5' and the nuts 4, 4' are, for instance, placed on the first end of the respective pin bodies 60, 60'. An underside of the washers 5, 5' sits against a second side of the substrate 3. By tightening the nuts 4, 4', the side supports 6, 6' are mechanically fixed to the substrate 3. With knowledge of the present invention, experts can, of course, implement other positive or non-positive connections of the side support to the substrate.

At a second point, the side supports 6, 6' are mechanically fixed with respective sides of the rail base 13, 13' of the guide rail 1. The holes 31, 31' in the substrate 3 are, for example, an oblong hole along the lateral axis Y-Y', allowing alignment of the side supports 6, 6' in relation to the sides of the rail base 13, 13' of the guide rail 1. The guide rail 1 laterally lies against the sleeves 61, 61'. As a result of lying laterally against the side supports 6, 6', all lateral movements of the guide rail 1 in relation to its longitudinal alignment are limited to the extent that the design of the side support permits such a lateral movement. Although not mandatory, such side supports 6, 6' are preferably mounted in pairs and/or on both sides at the same height in relation to their longitudinal alignment on guide rail 1.

Figure 2A:
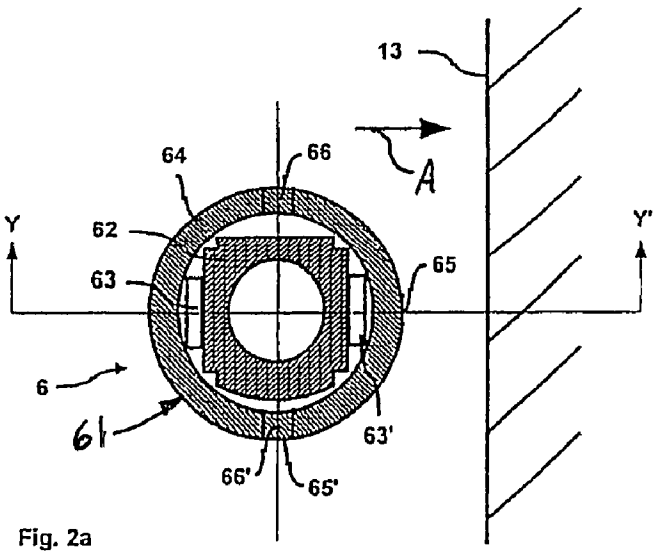
FIGS. 2*a* through 2*c* are schematic views showing a positioning of the guide rail against one side support of the fixing device shown in FIG. 1.
Figure 2B:
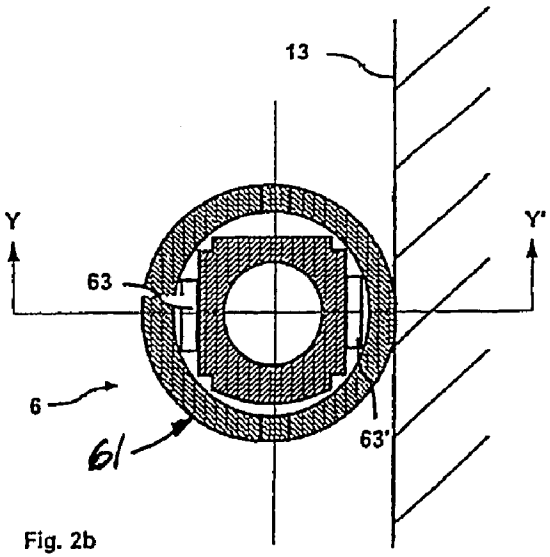
Figure 2C:
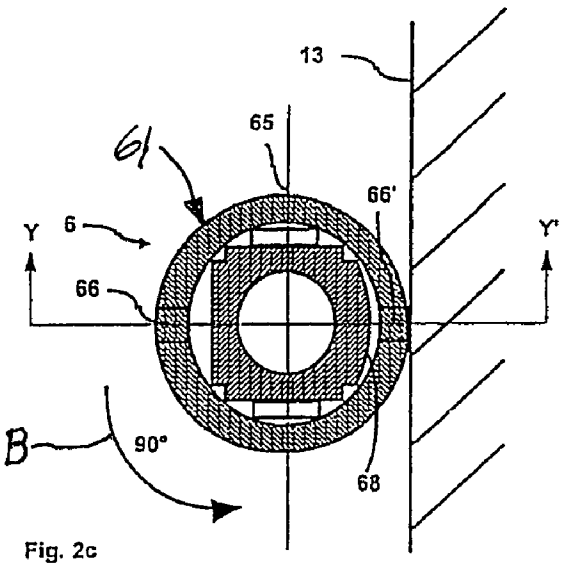

Details of how the guide rail 1 sits laterally against the side supports 6, 6' are shown in the diagrammatic positioning sequence of a guide rail on a side support in the exemplary embodiment shown in FIGS. 2*a* to 2*c*. FIGS. 2*a* to 2*c* represent a top view of a section of the side support 6, with the side support 6 being positioned on the side of a rail base 13 of the guide rail 1. The sleeve 61 of the side support 6 comprises at least one inner sleeve element 62, as well as at least one flexible sleeve element 63, 63' and at least one outer sleeve element 64. The inner sleeve element 62 as well as the outer sleeve element 64 are at least partially made from metal, i.e. from steel, stainless steel, etc. or from plastic. The flexible sleeve elements 63, 63' are preferably made from flexible material such as plastic, rubber, metal, etc. The flexible sleeve elements 63, 63' are preferably made from elastomer material with a long life of, for instance, twenty years. It is also possible make the flexible sleeve elements 63, 63' from spring steel, for example, in form of a spring assembly or a spring disc. The inner sleeve element 62 has a central aperture for receiving the pin 60.

The flexible sleeve elements 63, 63' can, for instance, be arranged to be in contact with the inner sleeve element 62 and the outer sleeve element 64 and can be vulcanised together, as shown. Alternatively, the parts can be joined using a two-component plastic. The two rectangular or circular flexible sleeve elements 63, 63' can, for instance, be arranged on a plane between the inner sleeve element 62 and the outer sleeve element 64. The two flexible sleeve elements 63, 63' can, for instance, be arranged on a plane perpendicular to the height axis Z-Z' and on this plane, the individual flexible sleeve elements 63, 63' are arranged opposite each other. The outer sleeve element 64 comprises, for instance, a mainly circular outer diameter with at least one flat-topped support 65, 65' on an outer side. The two supports 65, 65' can, for instance, be arranged on one plane perpendicular to the height axis Z-Z' and on this plane, the supports 65, 65' are arranged perpendicularly to each other. Optionally, the outer sleeve element 64 can also contain at least one knop 66, 66'. The two knops 66, 66' can, for instance be arranged on an underside and near to the outer side of the outer sleeve element 64. For detachable engagement, the knops 66, 66' require respective knop openings. Such knop openings are, for instance, provided in the base support 2. The use of knops 66, 66' is thus optional and makes sense when respective knop openings, i.e. in the base support 2, are used. Preferably, two of the flexible sleeve elements 63, 63' and the support 65 are arranged along a first line—defining a positioning direction—whilst perpendicular to the line and along a second line—defining a fixing direction—the support 65' and two additional knops 66, 66' are arranged.

The flexible sleeve elements 63, 63' form compressible bodies that can only be compressed or expanded under the influence of an interfering force, i.e. under the influence of an interfering force along the lateral axis Y-Y' (FIG. 2*c*). Such a compression or expansion also allows pre-tensioning of the side support 6 against the side of the rail base 13. The length of compression or extension as well as the characteristics of the compression or expansion of these flexible sleeve elements 63, 63' can be freely adjustable. The preceding description also applies to the side support 6'.

The installation of the side support 6 on the side of the rail base 13 is preferably carried out in two steps:

In a first step as shown in FIGS. 2*a* and 2*b*, the side support 6 is moved along the lateral axis Y-Y' against the side of the rail base 13 (indicated by a longitudinal movement arrow A in FIG. 2*a*). Preferably, as shown in FIG. 1, the side support 6 is guided in the hole 31 in the form of an elongated hole in the substrate 3 and in the base support 2. By advantageously fully tightening the nut 4 on the pin body 60, the side support 6 is mechanically fixed on the substrate 3 via a bottom strip unit 22. Using the support 65, the side support 6 is rested predominantly stress free against the side of the rail base 13 along the positioning direction. In this positioning direction, the two flexible sleeve elements 63, 63' are, for instance, slightly compressed along the lateral axis Y-Y'.

In a second step, as shown in FIG. 2*c*, the side support 6 is turned by 90° from the positioning direction into the fixing direction (indicated by a circular movement arrow B). Using the support 65', the side support 6 is moved into the pre-tensioned position against the side of the rail base 13 along the fixing direction and is mechanically fixed by engaging the knops 66, 66' in the respective knop openings of the base support 2. The amount of pre-tensioning generated by the flexible sleeve elements 63, 63' during the turning of the fixing side support 6 can be accurately determined by selecting the suitable distances of the supports 65, 65' from the pivot point of the side support 6. The outer sleeve element 64 can, for instance, comprise at least one opening, accommodating a rod-like tool for turning the side support 6 by 90°. The flexible sleeve element 63' is, for instance, more heavily compressed along the lateral axis Y-Y' in this fixing direction.

This pre-tensioned fixing of the guide rail 1 by the side supports 6, 6' forms part of a floating mount for the guide rail 1. By compressing or expanding the flexible sleeve elements 63, 63', the influence of an interfering force, i.e. the influence of an interfering force along the lateral axis Y-Y', can be absorbed. A radial offset and an angular offset between the guide rail 1 and the floating mount, implemented with the device, can thus be compensated for.

Upon movement of an elevator car along the guide rail 1, temporary interfering forces act on the guide rail 1, in particular, transversely to its longitudinal direction. As soon as such interfering forces are generated, the outer sleeve element 64 is displaced in relation to the inner sleeve element 62 and the flexible sleeve elements 63, 63' along the lateral axis Y-Y' are stressed or relieved. The distance by which the guide rail 1 can move transversely to its longitudinal direction under the influence of a temporary interfering force is limited by the fact that a lateral face 68 of the inner sleeve element 62, facing the guide rail 1 forms a mechanical stop for the outer sleeve element 64. If the strength of the temporary interference is such that the outer sleeve element 64 rests against the lateral face 68, the entire interfering force can be directly absorbed by the side support 6 and transferred to the substrate 3 via the pin body 60.

This installation of the side supports 6, 6' in the substrate 3 and laterally at the guide rail 1 can be simply, securely and accurately implemented. These embodiments of a side support, the fixing of the side support in the substrate and the positioning of the guide rail on a side support serve only as examples. With knowledge of the present invention, experts can implement lateral guide rail fixings and positioning procedures not shown in this disclosure. A side support can, i.e. be used with any number of flexible sleeve elements. A side support can also be used with any size of flexible sleeve elements. Also, a side support with randomly spaced flexible sleeve elements can be used.

Figure 3A:
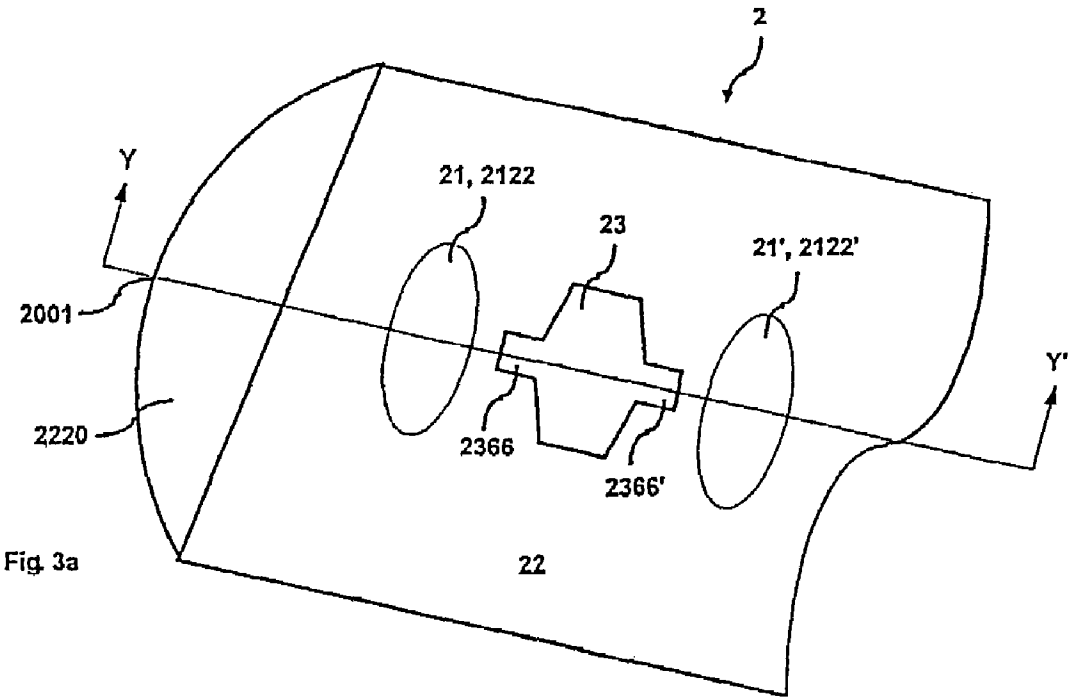
FIG. 3*a* is a perspective view and FIG. 3*b* is a cross-sectional view of the base support of the fixing device shown in FIG. 1.
Figure 3B:
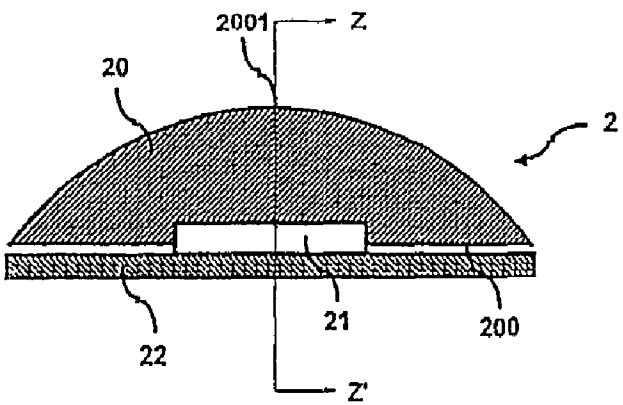

Although not mandatory, the device according to the present invention preferably contains at least one of the base support 2, installed between the guide rail 1 and the substrate 3. Details about the base support 2 are shown in the exemplary embodiment of FIGS. 1, 3*a* and 3*b*. The base support 2 includes, for instance, the bottom strip unit 22, extending at least partially around a top strip unit 20 and holding the latter. Two ends 2220, 2220' of the bottom strip unit 22 can, for instance, extend around two lateral ends of the top strip unit 20, clamping the top strip unit 20. The bottom and top strip unit can, for instance, be made from metal, i.e. from steel, stainless steel, etc. or plastic.

The base support 2 can be easily, securely, quickly and accurately installed. It can, for instance, comprise at least one opening 23, 23' through which the respective pin bodies 60, 60' of the side supports 6, 6' extend. During installation of the side supports 6, 6', the base support 2 is secured between the guide rail 1 and the substrate 3. The base support 2 allows the pre-tensioning of the side supports 6, 6' to be fixed. For this purpose, the opening 23, 23' can, for instance, comprise at least one laterally formed knop opening 2366, 2366' to mechanically fix the respective knops 66, 66' of the base support 2.

The base support 2 can, for instance comprise at least one flexible strip unit 21, 21', 21", 21'". In each case, two of the flexible strip units 21, 21', 21", 21'" can, for instance, be arranged at a distance next to the respective openings 23, 23'. The flexible strip units 21, 21', 21", 21'" are advantageously made from a flexible material such as plastic, rubber, metal, etc. Preferably, the flexible strip units 21, 21', 21", 21'" are made from elastomer material with a long life of, for instance, twenty years. It is also possible to make the flexible strip units 21, 21', 21", 21'" from spring steel, for example, in form of a spring assembly or of a spring disc. The flexible strip units 21, 21', 21", 21'" can, for instance, be at least partially embedded in a recess in the base support 2. Preferably, the strip units 21, 21', 21", 21'" are embedded in at least one recess of the top strip unit 20, protruding with one end 2122 from this recess along the height axis Z-Z' and resting with this end 2122 against the bottom strip unit 22. In the embodiment according to FIG. 1, four, i.e., circular flexible strip units (21, 21', 21", 21'"), protrude advantageously from recesses in a base area 200 of the top strip unit 20, rest against the bottom strip unit 22 and form a part of the floating mount of the guide rail 1.

The flexible strip units 21, 21', 21", 21'" form pressure stages, i.e. compressible bodies that can be compressed or extended under the influence of an interfering force, i.e., the influence of an interfering force along the height axis Z-Z'. As a result of such a compression or expansion of the flexible strip units 21, 21', 21", 21'", the interfering force is absorbed. The length of compression or extension as well as the characteristics of the compression or extension of these flexible strip units 21, 21', 21", 21'" can be freely adjustable. With knowledge of the present invention, experts can use many variations of base supports. A base support can, i.e., be used with any number of flexible strip units. A base support can also be used with any size of flexible strip units, such as oblong rectangular flexible strip units. Also, a base support with randomly spaced flexible strip units can be used. It is also possible to use a base support containing a tensioning as well as a compression stage.

By using the base support 2, it is thus possible to compensate for positional angular deviations of the guide rail 1 or of the substrate 3 due to building conditions or the installation.

Such positional deviations can be caused by thermal expansion of the guide rail or of the device for attaching the guide rail or of the base or can be caused by the wind load of the building in which the elevator system is installed or it can be caused by traffic load, i.e. impacts or compression caused by the passing elevator car. This compensation of the positional deviation is automatic, i.e. due to the dimension and characteristic of the compression of the used flexible strip units. The radial offset and the angular offset between the guide rail 1 and the floating mount, provided by the fixing device according to the present invention, can thus be compensated for.

The base support 2 comprises, for instance, the top strip unit 20 with a crescent-shaped cross section. Preferably, the top strip unit 20 comprises an apex line 2001 and the base area 200. The apex line 2001 serves as a support for the guide rail 1, if the base support is arranged without angular offset in relation to the guide rail 1. The crescent-shaped cross section of the top strip unit 20 ensures that even if the base area 200 is not parallel to the rail base 11, i.e., contains an angular offset in relation to the guide rail 1, the guide rail 1 still only rests on the top strip unit along one line. The fact that the guide rail 1 rests along one line on the base support 2 provides the prerequisite for attaching the guide rail without forcing a mechanical moment onto the guide rail 1, thus leading—compared to the prior art—to a reduction of positional deviation, even during continuous operation.

In case of a temporary interfering force arising during the operation, the flexible strip units 21, 21', 21", 21'" are stressed or relieved. Under the influence of such an interfering force, the top strip unit 20 and thus the guide rail 1 can, for instance, be moved perpendicular to the bottom strip unit 22. The movement of the top strip unit 20 towards the bottom strip unit 22 is limited, as the bottom strip unit 22 forms a mechanical stop for the top strip unit 20. As the flexible strip units 21, 21', 21", 21'" are embedded in recesses in the top strip unit, each of the flexible strip units 21, 21', 21", 21'" only has to be compressed by a fraction of its extension to make the top strip unit 20 rest against the bottom strip unit. If the strength of the temporary interference is such that the top strip unit 20 pushes against the bottom strip unit 22, these interfering forces are directly absorbed by the bottom strip unit 22 or the substrate 3.

Although not mandatory, the device preferably contains at least one backside support 9, 9' and at least one claw 8, 8'. The backside supports 9, 9' and the claws 8, 8' are, at least partially, made from metal, i.e., steel, stainless steel, etc. The backside supports 9, 9' and the claws 8, 8' are fixed on at least two physically separated points.

At a first point, the backside supports 9, 9' and the claws 8, 8' are mechanically fixed with a respect one of the side supports 6, 6'. For installation, the backside supports 9, 9' and the claws 8, 8' are positioned on the respective pin bodies 60, 60'. The backside supports 9, 9' and the claws 8, 8' can, i.e. contain central openings or passages 77, 77' accommodating a second end of the pin bodies 60, 60' of the side supports 6, 6'. The pin bodies 60, 60' protrudes through the central openings of the respective backside supports 9, 9' and the claws 8, 8'. The second ends of the pin bodies 60, 60' can, for instance, contain a thread accommodating at least one of the set nuts 7, 7' on a section. Each of the set nuts 7, 7' is placed on the respective pin body 60, 60'. By tightening the set nuts 7, 7', the backside supports 9, 9' and the claws 8, 8' are mechanically fixed with the side supports 6, 6'. With knowledge of the fixing device according to the present invention, experts can, of course, implement other positive or non-positive connections of the pin body and set nut.

At a second point, the claws 8, 8' are mechanically fixed with a rail base back 12 of the guide rail 1. A first underside of the claws 8, 8' can, for instance, rest on the rail base back 12 of the guide rail 1. As a result of the claws 8, 8' resting on the rail base back 12, the guide rail 1 does not lift off the base support 2. Although not mandatory, the backside supports 9, 9' and the claws 8, 8' are preferably mounted in pairs and/or on both sides at the same height in relation to the longitudinal alignment of the guide rail 1.

Optionally and at a third point, the claws 8, 8' are mechanically fixed with the base support 2. A second underside of the claws 8, 8' can, for instance, rest on one upper side of the base support. 2. In this way, interfering forces, transferred from the guide rail 1 to the first underside of claws 8, 8' can be transferred to the base support 2 via the claws.

Figure 4:
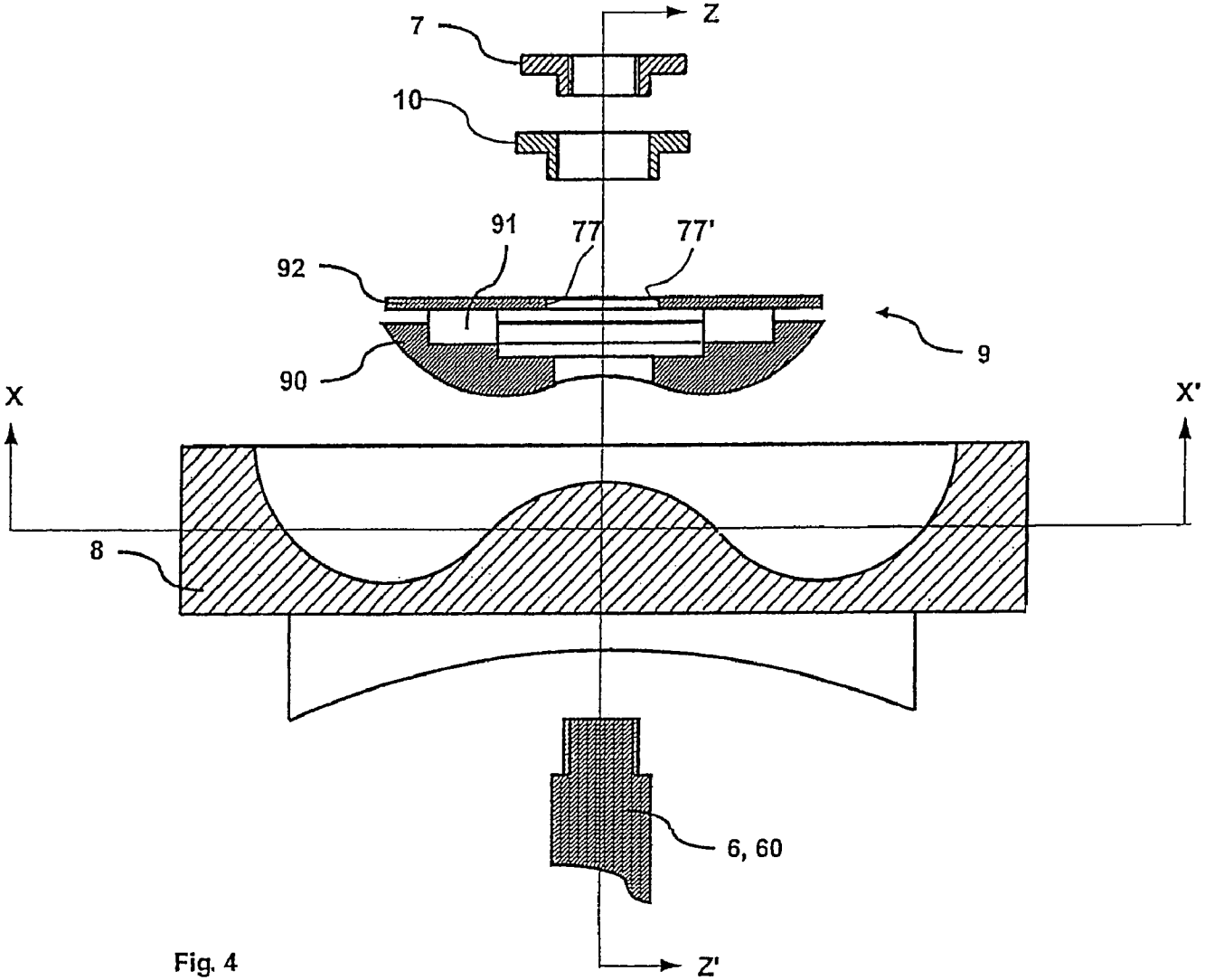
FIG. 4 is an enlarged exploded view of a part of one of the backside supports of the fixing device shown in FIG. 1.

Details showing the backside supports 9, 9' and the claws 8, 8' resting on the guide rail 1 are shown in the exemplary embodiment of the backside support 9 and the claw 8 according to FIG. 4. In this exploded view, the backside support 9 comprises at least one bottom disc element 90, at least one flexible disc element 91 and at least one top disc element 92. The bottom disc element 90 as well as the top disc element 92 is, at least partially, made from metal, i.e. steel, stainless steel, brass, etc. The flexible disc element 91 is advantageously made from a flexible material such as plastic, rubber, metal, etc. Preferably, the flexible disc element 91 is made from an elastomer material with a long life of, for instance twenty years. It is also possible to use a flexible disc element as the disc element 91 made from spring steel, for example, in form of a spring assembly or of a spring disc.

The flexible disc element 91 can, for instance, be arranged in close contact with the bottom disc element 90 and the top disc element 92. A closed annular flexible disc element 91 can, for instance, be arranged on a plane between the bottom disc element 90 and the top disc element 92. The bottom disc element 90, the flexible disc element 91 and the top disc element 92 can, for instance, be positively or non-positively connected. The flexible disc element 91 can, for instance, be arranged on a plane perpendicular to the height axis Z-Z' and parallel to the lateral axis Y-Y'. The bottom disc element 90 can, for instance, comprise a mostly concave underside and lies in a respective convexly formed inner surface of the claw 8 with this concave underside. The top disc element 92 can, for instance, contain a mostly flat upper side.

By tightening the set nut 7, the bottom disc element 90 and the top disc element 92 are moved towards each other and the flexible disc element 91 is compressed along the height axis Z-Z'. The flexible disc element 91 forms a pressure stage, i.e., a compressible body, compressible or extendable under the influence of an interfering force, i.e. under the influence of an interfering force along the height axis Z-Z'. As a result of such a compression or extension of the elastic disc element 91, the interfering force is absorbed. The length of compression or extension as well as the characteristics of the compression or extension of the elastic disc element 91 can be freely adjustable. The disc element 91 is embedded in a recess in the bottom disc element 90. In case of a temporary interference acting on the guide rail 1 in the direction of the backside support 9, the guide rail 1 or the bottom disc element 90 can be moved towards the top disc element 92 to such an extent that the bottom disc element 90 makes contact with the top disc element 92. The top disc element 92 thus has the function of a mechanical stop. In order to be able to move the bottom disc element 90 against the top disc element 92, the flexible disc element 91 must only be compressed along part of its extension. If the temporary forces are such that the bottom disc element 90 comes into contact with the top disc element 92, these interfering forces are directly absorbed by the top disc element 92 and diverted into the substrate 3 via the side support 6.

As apparent from FIG. 1, the area of each of the claws 8, 8' resting on the back of the rail base 12, is designed as an arched surface. In this way, a line support is implemented between the claws 8, 8' and the back of the rail base 12, in order to retain the guide rail 1 and the claws 8, 8' without a mechanical moment, where at all possible.

In this way, the radial offset and the angular offset between the guide rail 1 and the floating mount implemented with the fixing device according to the present invention can thus be compensated for. Any existing angular offset, caused for instance by an inaccurate position of the pin bodies 60, 60' or the substrate 3 in relation to the guide rail 1, is compensated for by a respective relative position of the bottom disc element 92 to the complementary inner surface of the claws 8, 8'. Consequently, an angular offset in wide areas has no effect on the force with which the claws 8, 8' are tensioned against the back of the rail base 12. In this way it will be possible to retain the guide rail 1 without the need for a mechanical moment.

In this way, the backside supports 9, 9' can also be installed on the back of the rail base 12 whilst being pretensioned. Although not mandatory, the backside supports 9, 9' and the claws 8, 8' are preferably mounted in pairs and/or on both sides at the same height in relation to their longitudinal alignment of the guide rail 1. This pretensioned fixing of the guide rail 1 by the backside supports 9, 9' forms part of a floating mount of the guide rail 1. The pretensioning of the fixing of the guide rail 1 can, for instance, be adjusted and corrected by simply turning the set nuts 7, 7' if the guide rail 1 is no longer fully resting on the substrate 3 or on the base support 2. In particular, where the guide rail 1 only rests with one side, i.e. only with its left or right side on the crescent-shaped top strip unit 20 of the base support 2, the fixing of the guide rail 1 can be easily, quickly, securely and accurately adjusted by opening and/or closing the set nuts 7, 7'.

With knowledge of the fixing device according to the present invention, numerous backside support variations are available to experts. A backside support can, i.e. be used with any number of flexible disc elements. A backside support can also be used with any size of flexible disc elements, such as oblong rectangular flexible disc elements. Also, a backside support with randomly spaced flexible disc elements can be used. It is also possible to use a backside support containing a tensioning as well as a compression stage.

A preferred combination of side supports 6, 6', base support 2 and backside supports 9, 9' combined with the claws 8, 8' forms a floating mount, absorbing radial and angular interfering forces. The side supports 6, 6' and the backside supports 9, 9' as well as the claws 8, 8' can, for instance, be installed on the base support 2. As a result, interfering forces are transferred from the side supports 6, 6' and the backside supports 9, 9' and the claws 8, 8' to the base support 2. The pretensioning of the side supports 6, 6' can, for instance, be mechanically fixed on the base support 2. The pretensioning of the backside supports 9, 9' and the claws 8, 8' can, for instance, be mechanically fixed on the side supports 6, 6'.

Figure 5:
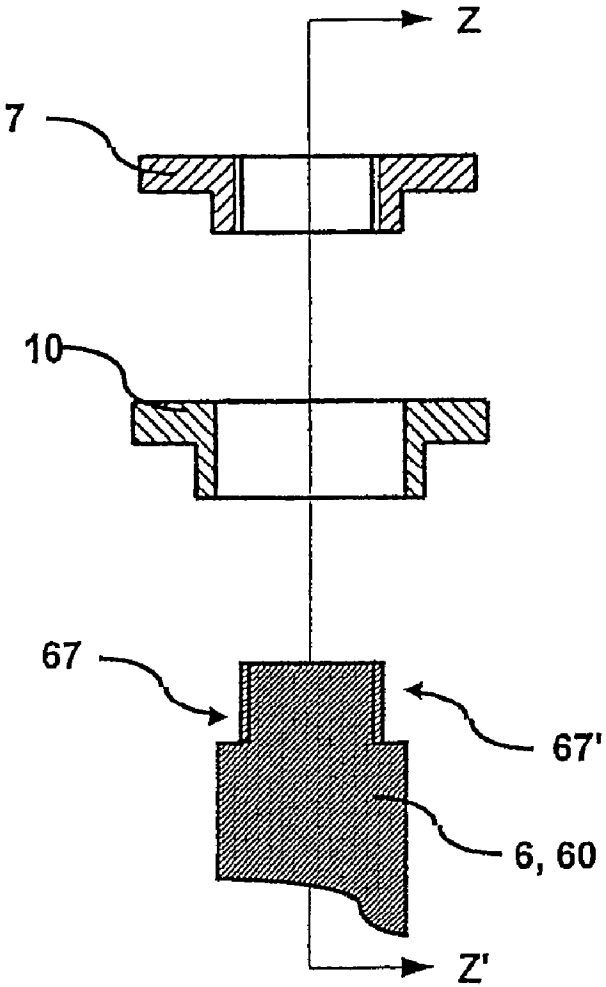
FIG. 5 is an enlarged exploded fragmentary view of a rail side part of a securing means of the fixing device shown in FIG. 4.

Although not mandatory, the device preferably contains at least one securing means 10, 10'. FIGS. 1 and 5 show an exemplary embodiment of the securing means 10, 10'. The securing means 10, 10' is at least partially made from metal, i.e. steel, stainless steel, etc. The securing means 10, 10' serves to secure the setting of the backside supports 9, 9' by screwing the set nuts 7, 7' onto the respective pin bodies 60, 60'. For this purpose, the securing means 10, 10' contain locking retention means, which upon placing the securing means 10, 10' onto the respective set nuts 7, 7' extend through the respective at least one passages 77, 77' (FIG. 4) of the pin bodies 60, 60' screwed onto the set nuts 7, 7' and positively engage into the at least one recesses 67, 67' of the pin bodies 60, 60'. This method for securing the backside support serves as an example. With knowledge of the fixing device according to the present invention, numerous variation options of such a securing means are available to experts.

The embodiments for the base support 2 or side support 6, 6' or backside supports 9, 9' shown in FIGS. 1-4 have a common feature: they all comprise a flexible element, a mechanical stop and a moveable mechanical part. The flexible element is in the form of the flexible strip units 21, 21', 21", 21'", or the flexible sleeve elements 63, 63', or the flexible disc element 91. The mechanical stop is in form of the bottom strip unit 22, or the lateral face 68 of the inner sleeve element 62 of the side support, or the top disc element 92, each serving as a mechanical stop for the moveable mechanical part. The moveable mechanical part is in form of the top strip unit 20, or the outer sleeve element 64, or the bottom disc element 90, each floatingly supported with the aid of the respective flexible element. The splitting of the respective fixing into a flexible element and a mechanical element, serving as a mechanical stop, allows optimization options, offering advantages. The material parameter and/or the form and/or the arrangement of the flexible element and the mechanical element serving as a stop can, for instance, be matched in such a way that (i) the fixings exert an as low as possible force on the installed guide rail 1 and that (ii) high temporary interfering forces that can momentarily stress the guide rail or the respective fixing during operation, are absorbed by an element acting as a mechanical stop, if the extent of the temporary interfering force exceeds a predetermined limit. Optimized fixings thus facilitate a floating mount of the guide rail 1 in such a way that, on one hand, the guide rail 1 can be highly stressed during operation but, on the other hand, is only subjected to low holding forces in its basic state after installation. With the aid of the fixings of the present invention, these holding forces can be reduced to a considerably lower level than when using conventional prior art fixings. As, in addition, the guide rail 1 can be installed with the fixings of the invention in such a way that no mechanical moment is exerted onto the guide rail, this provides the prerequisite for a particularly low resistance between the guide rail 1 and the fixings in the longitudinal direction of the guide rail. Such a fixing of the guide rail reduces the danger of the guide rail being bent, when the point of the substrate 3 on which the guide rail 1 is fixed, is subjected to a change during continuous operation. Obviously, embodiments of the fixings, in which the respective flexible are directly in contact with the guide rail 1, are also possible. Modifications, in which the pressure and/or tension load of the respective flexible elements is limited by respectively arranged stop elements are also feasible.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for attaching a guide rail to a substrate with a floating mount comprising the steps of:

a) providing a guide rail having a rail base;

b) providing at least one fixing device having at least one flexible element and a stop including forming the flexible element with a base support retaining at least one flexible strip unit and forming the base support with a crescent shaped top strip unit having an apex line;

c) attaching the rail base to a substrate with the at least one fixing device by installing the base support between the guide rail and the substrate and positioning the rail base on the apex line whereby when the guide rail is temporarily subjected to a deforming force moving the guide rail relative to the substrate in a deforming direction, the at least one flexible element is deformed; and d) when the deforming force exceeds a predetermined limit, limiting further movement of the guide rail in the deforming direction with the stop.

2. The method according to claim 1 wherein the deforming movement is along a height axis perpendicular to a longitudinal axis of the guide rail and to the rail base.

3. The method according to claim 1 wherein the deforming movement is along a lateral axis perpendicular to a longitudinal axis of the guide rail and parallel to the rail base.

4. The method according to claim 1 wherein the deforming movement is along at least one of a height axis perpendicular to a longitudinal axis of the guide rail and to the rail base and a lateral axis perpendicular to a longitudinal axis of the guide rail and parallel to the rail base.

5. The method according to claim 1 including a step of forming the flexible element with a side support retaining at least one flexible sleeve element.

6. The method according to claim 5 wherein said step c) includes installing the flexible sleeve element in a pretensioned condition.

7. The method according to claim 5 wherein said step c) is performed by installing the side support and another side support on each of opposite sides of the rail base.

8. The method according to claim 1 including a step of forming the flexible element with a backside support retaining at least one flexible disc element and at least one claw.

9. The method according to claim 8 wherein said step c) includes installing the flexible disc element in a pretensioned condition.

10. The method according to claim 8 wherein said step c) is performed by installing one of the backside supports and one of the claws on each of opposite sides of the rail base.

11. A device for attaching a guide rail to a substrate comprising:

support means adapted to attach the guide rail to a substrate;

a moveable part attached to said support means;

a flexible element floatingly supporting said moveable part; and a stop adjacent said moveable part whereby when the guide rail is attached to the substrate by said support means and a deforming force is applied to the guide rail moving the guide rail and said moveable part in a deforming direction, said flexible element deforms until the deforming force exceeds a predetermined limit whereupon said stop engages said moveable part and prevents further movement of the guide rail in the deforming direction, wherein said moveable part includes a top strip unit adapted to engage the guide rail and said flexible element includes at least one flexible strip unit retained between said top strip unit and said stop, wherein the deforming direction includes alone a height axis of the guide rail, and wherein said top strip unit is crescent shaped in profile with an apex line upon which a rail base of the guide rail is positioned.

12. The device according to claim 11 wherein said moveable part is includes an outer sleeve adapted to engage the guide rail, said stop includes a face of an inner sleeve positioned inside said outer sleeve, and said flexible element includes at least one flexible sleeve element positioned between said outer sleeve and said inner sleeve, and wherein the deforming direction includes along a lateral axis of the guide rail.

13. The device according to claim 12 wherein said flexible sleeve element is pretensioned.

14. The device according to claim 11 wherein said moveable part is includes a bottom disc, said stop includes a top disc and said flexible element is a flexible disc positioned between said bottom disc and said top disc, and wherein the deforming direction is along the height axis of the guide rail.

15. The device according to claim 14 wherein said flexible disc is pretensioned.

16. The device according to claim 11 wherein said flexible element compensates for any radial offset and angular offset between the guide rail and said support means.

17. The device according to claim 11 wherein said flexible element is formed of one of a flexible plastic material, a flexible rubber material and a flexible metal material.

18. The device according to claim 11 wherein said support means includes at least one pin extending through apertures formed in a base support and the substrate and at least one fastener co-operating with said pin to attach the guide rail to the substrate.

19. The device according to claim 11 wherein said moveable part includes a top strip unit adapted to engage to guide rail and said flexible element includes at least one flexible strip unit retained between said top strip unit and said stop, and wherein the deforming direction includes along a height axis of the guide rail.

20. A device for attaching a guide rail to a substrate comprising:

support, means adapted to attach the guide rail to a substrate;

a moveable part attached to said support means and including an outer sleeve adapted to engage the guide rail;

a stop adjacent said moveable part and including a face of an inner sleeve positioned inside said outer sleeve; and a flexible element floatingly supporting said moveable part, said flexible element including at least one flexible sleeve element positioned between said outer sleeve and said inner sleeve whereby when the guide rail is attached to the substrate by said support means and a deforming force is applied to the guide rail moving the guide rail and said moveable part in a deforming direction, said flexible element deforms until the deforming force exceeds a predetermined limit whereupon said stop engages said moveable part and prevents further movement of the guide rail in the deforming direction, the deforming direction being along a lateral axis of the guide rail.

21. The device according to claim 20 wherein said flexible sleeve element is pretensioned.

22. The device according to claim 20 wherein said moveable part includes a bottom disc, said stop includes a top disc and said flexible element is a flexible disc positioned between said bottom disc and said top disc, and wherein the deforming direction includes along a height axis of the guide rail.

23. The device according to claim 22 wherein said flexible disc is pretensioned.

24. The device according to claim 20 wherein said flexible element compensates for any radial offset and angular offset between the guide rail and said support means.

25. The device according to claim 20 wherein said flexible element is formed of one of a flexible plastic material, a flexible rubber material and a flexible metal material.

26. The device according to claim 20 wherein said support means includes at least one pin extending through apertures formed in a base support and the substrate and at least one fastener co-operating with said pin to attach the guide rail to the substrate.

* * * * *